United States Patent [19]

Fuller

[11] 3,999,884

[45] Dec. 28, 1976

[54] COMPENSATED PROPELLER NOZZLES OR DUCTS

[76] Inventor: Ronald George Fuller, P.O. Box 337, Hudson Heights, Quebec JOP IJO, Canada

[22] Filed: Aug. 1, 1974

[21] Appl. No.: 493,753

[52] U.S. Cl. ..... 415/144; 416/189; 60/221

[51] Int. Cl.[2] ..... B63H 5/14

[58] Field of Search ..... 416/181, 189; 415/144, 415/172 A

[56] References Cited

UNITED STATES PATENTS

| | | | |
|---|---|---|---|
| 1,730,748 | 10/1929 | Schmidt | 415/144 |
| 2,566,525 | 9/1951 | Kort | 60/221 X |
| 2,756,713 | 7/1956 | Kort | 415/119 |
| 3,508,517 | 4/1970 | Hannan | 60/221 X |
| 3,672,169 | 6/1972 | Ufer | 60/221 X |
| 3,677,660 | 7/1972 | Taniguchi et al. | 415/172 |

FOREIGN PATENTS OR APPLICATIONS

| | | | |
|---|---|---|---|
| 498,391 | 1/1920 | France | 416/189 |

*Primary Examiner*—Everette A. Powell, Jr.

[57] ABSTRACT

A propeller nozzle provided with duct means whereby fluid may be circulated from the area of higher pressure adjacent the lowermost propeller blade position to an area of lower pressure adjacent the uppermost blade positon in order to equalise the pressure differential across the vertical diameter of a propeller disc resulting from the different depth of submergence. This reduces the amplitude of cyclic stress acting upon the roots of the propeller blades.

3 Claims, 3 Drawing Figures

COMPENSATED PROPELLER NOZZLES OR DUCTS

BACKGROUND TO THE INVENTION

This invention relates to improvements in nozzles or ducts embracing a screw propeller of large diameter such that there is a significant differential between the hydrostatic pressure imposed upon the tip of a propeller blade when in the position of greatest submergence vertically below the propeller boss and the pressure imposed upon the tip of the same blade when in the position of minimum submergence vertically above the propeller boss. The invention provides means for substantially reducing this pressure differential and equalise the loading on the blade roots around the propeller, reducing vibration and noise.

DRAWING

Figure 3:
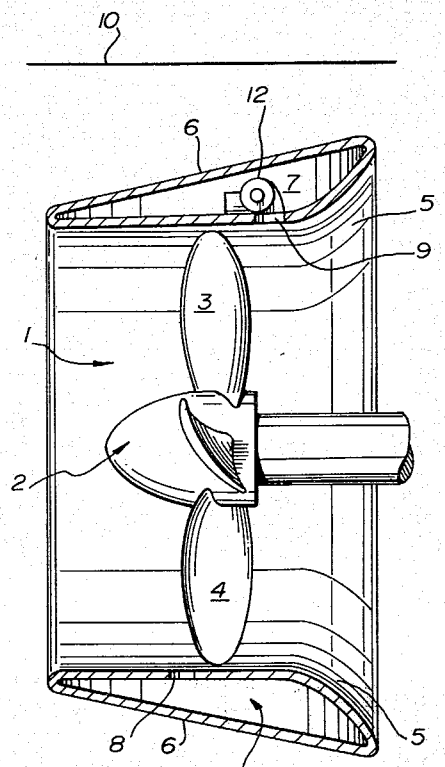
FIG. 3 shows an embodiment incorporating a pump.

In the Figure, 1 is a duct or nozzle, 2 is a screw propeller, 3 and 4 are propeller blades, 5 is the inner cylindrical wall of the nozzle, 6 is the outer wall of the nozzle, 7 is the void defined within wall 5 and 6, 8 is a passageway or passageways penetrating the inner wall at a point of high pressure adjacent to blade 4 and communicating with void 7, 9 is a passage or passageways penetrating the inner wall 5 in the upper half of nozzle circumference and communicating with void 7 which is in communication with passageway(s) 8 in the lower half of the nozzle circumference. 10 represents the interface between liquid and air.

From the Figure it will be seen that when immersed in liquid the stationary propeller will be subjected to a hydrostatic pressure varying from a minimum at the tip of the vertically uppermost propeller blade 3 which will be governed by the depth of submergence from the surface of the liquid 10, to a maximum at the tip of the vertically lowermost propeller blade 4 which will be governed by the depth of submergence from the surface of the liquid 10. The difference in pressure will be equivalent the greater submergence of 4 in relation to 3 and which in a large propeller may be in excess of 10 PSIG. When the propeller is rotated energy is transmitted to the liquid by blades 3 and 4 as a function of the energy imput into the propeller and the hydrostatic pressure of the liquid to which the energy is imparted. This introduces a pressure differential across the propeller blades in an axial direction and which varies across each individual blade in accordance with the hydrostatic pressure to which it may be subjected at any angular position through which it may pass.

It will be clear from the foregoing that an area of lower pressure will develop ahead of the uppermost blade tip 3 as indicated by *p* and an area of higher pressure will develop below the lowermost blade tip 4 as indicated by P.

Locating passageway 8 coincident with higher pressure area P and passageway 9 coincident with lower pressure area *p* brings the two pressure areas into communication via the void 7 whereby natural forces tending to maintain equilibrium promote a flow of liquid from area P to area *p* thereby tending to reduce the pressure differential across the propeller disc when the propeller is rotating thereby tending to equalise the work done by each blade around the propeller boss. This reduces the amplitude of cyclic stress acting upon the roots of the propeller blades.

Figure 2:
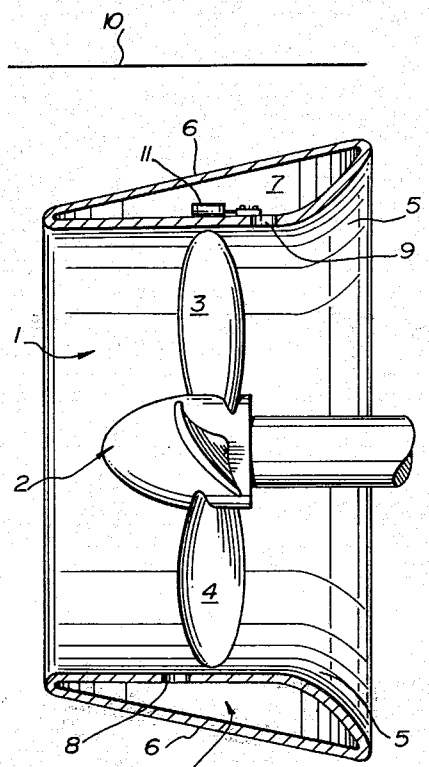
FIG. 2 shows an embodiment incorporating a valve.
Figure 1:
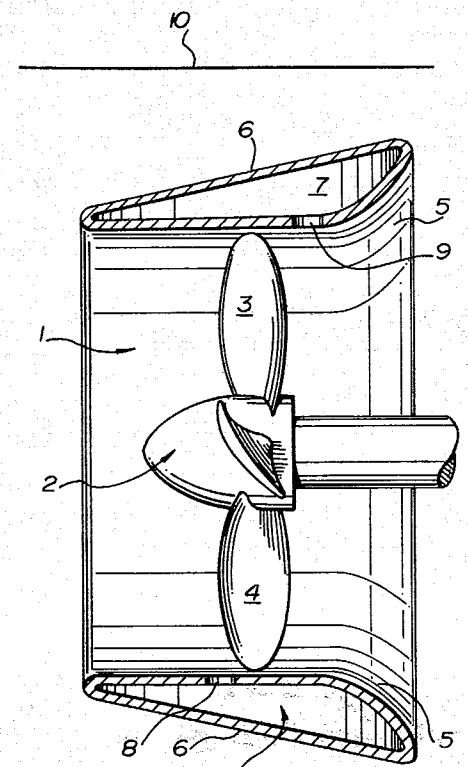
FIG. 1 shows one embodiment.

Whilst the embodiment described utilises fabricated nozzles characterised by having an annular void enclosed within the walls, the scope of the invention is not limited thereto and other types of nozzle and connecting passages may be used within the scope of the invention claims, together with valve or other means for modulating the flow of liquid through said communicating passageway(s). One such embodiment is shown in FIG. 2.

The flow of liquid from P to *p* under the natural force resulting from the pressure differential between the two zones may be accelerated and increased by the addition of energy from a source external to the nozzle or duct and be applied by known means such as a pump or ejector which will be familiar to one versed in the art. One such embodiment is shown in FIG. 3.

What I claim is:

1. A large diameter marine propeller comprising a propeller nozzle or duct, a propeller rotatably mounted on the axis of the duct within the duct, annular passage means around and enclosed within the circumference of the duct, an inlet communicating with the lower part of the annular passage means at the lower part of said duct and connecting said passage means to a zone of high pressure behind the propeller, and an outlet at the upper part of the passage means and connecting the passage means to a zone of lower pressure ahead of the propeller.

2. A propeller nozzle or duct as claimed in claim 1 having pumping means for accelerating the flow from the zone of high pressure to the zone of lower pressure.

3. A propeller nozzle or duct as claimed in claim 1 having valve means for modulating the flow through said passage means.

* * * * *